United States Patent [19]

Hagelberg et al.

[11] 4,433,606

[45] Feb. 28, 1984

[54] TANDEM ROCKET LAUNCHER

[75] Inventors: Allen C. Hagelberg, Diamond Bar; Clark E. Allardt, Claremont, both of Calif.

[73] Assignee: General Dynamics, Pomona Division, Pomona, Calif.

[21] Appl. No.: 299,362

[22] Filed: Sep. 4, 1981

Related U.S. Application Data

[62] Division of Ser. No. 133,756, Mar. 25, 1980, Pat. No. 4,342,252.

[51] Int. Cl.[3] ..... F41F 3/06; F42C 15/06

[52] U.S. Cl. ..... 89/1.812; 89/1.817

[58] Field of Search ..... 89/1.816, 1.817, 1.819, 89/1.818, 1.812, 1 R

[56] References Cited

U.S. PATENT DOCUMENTS

| | | | |
|---|---|---|---|
| 2,313,030 | 2/1943 | Tauschek | 89/135 |
| 2,445,423 | 7/1948 | Eastman | 89/1.812 X |
| 2,701,985 | 2/1955 | Smith | 89/1.812 |
| 2,763,189 | 9/1956 | Grill | 89/1.817 |
| 2,780,143 | 2/1957 | Graham | 89/1.817 |
| 2,930,288 | 3/1960 | Jonah | 89/1.817 |
| 2,998,754 | 9/1961 | Bialy | 89/1.816 |
| 3,048,086 | 8/1962 | Robert et al. | 89/1.817 |
| 3,318,241 | 5/1967 | Gould | 89/1.813 X |
| 3,342,104 | 9/1967 | Robert | 89/1.817 |
| 3,363,508 | 1/1968 | Stahmer | 89/1.818 |
| 3,861,271 | 1/1975 | Osborn, Jr. | 89/1.817 X |
| 3,962,951 | 6/1976 | Schenk | 89/1.817 X |
| 4,044,648 | 8/1977 | Piesik | 89/1.812 X |

FOREIGN PATENT DOCUMENTS

| | | | |
|---|---|---|---|
| 665970 | 10/1938 | Fed. Rep. of Germany . | |
| 1161985 | 3/1958 | France | 89/1.817 |
| 1196091 | 5/1959 | France | 89/1.816 |
| 316189 | 9/1956 | Switzerland | 89/1.816 |
| 935971 | 9/1963 | United Kingdom | 89/1.817 |
| 939806 | 10/1963 | United Kingdom | 89/1.817 |
| 1387669 | 3/1975 | United Kingdom | 89/1.816 |

*Primary Examiner*—David H. Brown

*Attorney, Agent, or Firm*—Henry M. Bissell; Edward B. Johnson

[57] ABSTRACT

A tandem rocket launcher is provided by mounting plural rockets in an elongated launch tube with associated guide and launch equipment for each rocket. A conical shield is placed between the rockets which deflects exhaust gases generated by firing the forward rocket away from the rearward rocket. The shield is then removed by firing of the subsequent rocket or pivoting of two halves of the deflector away from the path of travel of the subsequent rocket.

4 Claims, 6 Drawing Figures

TANDEM ROCKET LAUNCHER

This is a division of application Ser. No. 133,756 filed Mar. 25, 1980; now U.S. Pat. No. 4,342,252.

BACKGROUND OF THE INVENTION

1. Field of the Invention

The present invention relates to tandem rocket launchers. More particularly, the present invention relates to an improved system for providing plural axially-aligned rockets with exhaust gas deflectors to increase fire power.

2. Description of the Prior Art

Many different forms of rocket launching equipment have been suggested in the prior art. The rockets are usually stored in cylindrical tubes which provide initial guidance and storage prior to firing. Exemplary uses include under-wing-mounted rocket launching tubes on military aircraft and rocket launch tubes on surface ships.

In order to improve the fire power of this type of equipment on airplanes, it has been suggested that the rockets be mounted in tandem. That is, it has been suggested that at least two rockets be placed in a single elongated tube, so that they may be serially launched from the single tube. This structure is advantageous where the cross-sectional area of the rocket launch tube is more critical than the length of the rocket launch tube, as it increases fire power without increasing cross-sectional area.

Graham in U.S. Pat. No. 2,780,143 discloses a tandem rocket launcher for use on an airplane. Tandem launchers are mounted in pods on the ends of the wings of the airplane. Each pod contains a plurality of launch tubes, and each tube contains a plurality of rockets. Baffles are provided between the rockets in each tube, and a separate exhaust gas duct is provided at each baffle. After firing of the first rocket, the baffle behind it is lifted to close off the exhaust gas duct and provide a clear path for the second rocket. The structure utilizes a complex level system which rotates the baffle out of the path of the subsequent rocket by the use of a pivoted arm. The arm is rotated by the motion of the second rocket. This system requires the use of large ducts in order to accommodate the flat baffles and provide adequate space for the rockets. Additionally, the pivoting arms must be encased in the pod in order to prevent problems such as icing and to provide an aerodynamic surface on the airplane.

A second system has been disclosed by Jonah in U.S. Pat. No. 2,930,288. This system is also designed for rocket launching from airplanes. It uses a flap covering the forward end of the second of two axially aligned tubes to deflect exhaust gases exiting the first rocket tube away from the second rocket. Jonah uses spring biasing on the flap, and a latch which connects to the flap and holds it away from the path of travel of the rocket in the second tube. This system also requires external structure and is encased underneath the airplane. Thus it suffers from the same problems as those discussed above with respect to the Graham patent.

The structural requirements of both of the previously described tandem launchers present certain technical problems. First, a significant amount of external structure is required in order to cause the system to function properly. Second, where there would be exposure to the elements, an external covering system is necessary.

Third, in both units the second rocket is used to move the baffle or flap and the forces applied to the nose of the second rocket are not equally balanced. Thus the rocket could move radially in the tube and could jam and misfire. It is apparent that there is a need in the art for a simple deflection system for tandem rocket launching which overcomes these problems. It should be noted that the phrase "rocket" as used herein, is intended to include both guided and unguided rockets or missiles and other weaponry which utilizes launch tubes.

SUMMARY OF THE INVENTION

The present invention relates to a new tandem launcher design which provides improved launching capabilities. The unit utilizes an encased tube type of cylindrical rocket launcher and mounts at least two rockets axially in the tube, i.e. in a nose-to-tail relationship. In their preferred form, the rockets are surface or land launched rockets containing an internal guidance system and having the capability of being fired at a considerable standoff distance from the target.

The launch tube is provided with a pair of firing mechanisms and the associated guidance and directional control equipment normally provided for rocket launchers. All of this equipment is usually provided in duplicate, one set for the forward rocket and a separate set for the rearward rocket. In between the two rockets, the tube is provided with a pair of orifices which are normally laterally opposed to each other. The orifices function as rocket exhaust gas exits. Positioned between the orifices is a conical exhaust gas deflector which is effective to prevent flow of exhaust gases produced by launching of the first or forward rocket from entering the tube in the area of the second or aft rocket.

In one preferred form of the present invention, the conical exhaust gas deflector is formed of two symmetrical half-sections, each of which is attached to the inner core of the rocket tube and is rotatable out of the path of the second rocket. The rotation may be effected by the second rocket as it travels through the launch tube, since the rocket itself would be subjected to equal and opposite forces and would not be misaligned in the tube. Additionally, the rotation of each deflector half can be effected by connecting each to a lever and a rod and, for example, a servo unit which would rotate each half of the deflector out of the path of the second rocket. It should be noted that this type of deflector is, essentially, self-sealing since the impingement of the exhaust gases from the first rocket would tend to force the halves of the deflector together, and thus act as a safety device and further protect the second rocket.

In another preferred form, the exhaust gas deflector may be solid in its conical portion but provided with, for example, a destructable sealing ring at its intersection with the launch tube core. In this form, the exhaust gases of the first rocket would still be forced outwardly through the orifices in the sides of the launch tube. However, when the second rocket is fired, the frangible seal would be broken at the intersection noted above and the deflector would be pushed forward through the tube by the second rocket.

In this manner, the conical deflection-unit-containing tandem launcher of the present invention may be mounted in a conventional system. In fact, the tubes utilized in accordance with the present invention are adaptable for use with conventional rocket launching systems and thus approximately double the fire power of such systems. Factors such as the tube diameter, exhaust gas orifice size, and tube length are controlled by the size of the particular rocket to be fired, as well as by the relative amount of exhaust gases produced by the rocket, and thus are design factors and do not control the applicability of the launcher to existing weaponry. In addition, no large external lever and arm system is needed in order to provide the tandem launching system of the present invention, and the rockets are not twisted or misaligned by uneven application of force to the surfaces thereof during launching.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
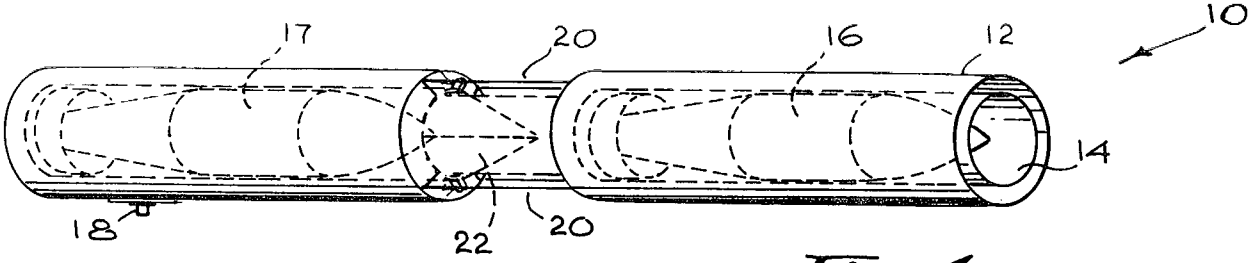
FIG. 1 is a schematic isometric view of the tandem rocket launching tube of the present invention.

In FIG. 1, the tandem launching system of the present invention is shown when used with an anit-submarine warfare rocket launching system, particularly one for use onboard ship. The tandem launching tube, indicated generally as 10, has an external shell 12, and internal shell 14 which is concentric with the external shell, and has plural rockets 16 and 17 axially mounted within the internal shell. Shoes or other connecting devices 18 are provided for mounting the tube in a launch structure and selectively directing the launch tube toward the target. A control system for selecting the firing position and the mounting structure are not shown here, for simplicity. The control system can be one normally used in the art; and in fact, the remainder of the launch system, including the mounting structure, may also be conventional. The tube 10 is provided with a pair of orifices 20 which are positioned on opposed sides of the tube. A different orifice structure may be provided, if desired. If structural needs require more tube strength, then, e.g. four opposed orifices may be used. Conical exhaust gas deflector 22 is positioned adjacent the holes in the tube which are produced by orifices 20. Thus deflector 22 directs exhaust gases of forward rocket 16 away from the aft rocket 17, and outward through the orifices when the forward rocket is launched. The conical deflector provides for symmetrical dispersion of the exhaust gases and thus even back pressure on the rocket. Thus the rocket would not tend to be misaligned during launch which would result in a decrease in accuracy, if not anger of the rocket becoming lodged or wedged in the launch tube. The pressure on the rocket is produced by the turbulence and backflow toward the rear of the rocket in an area away from the rocket exhaust outlet during launching.

Figure 2:
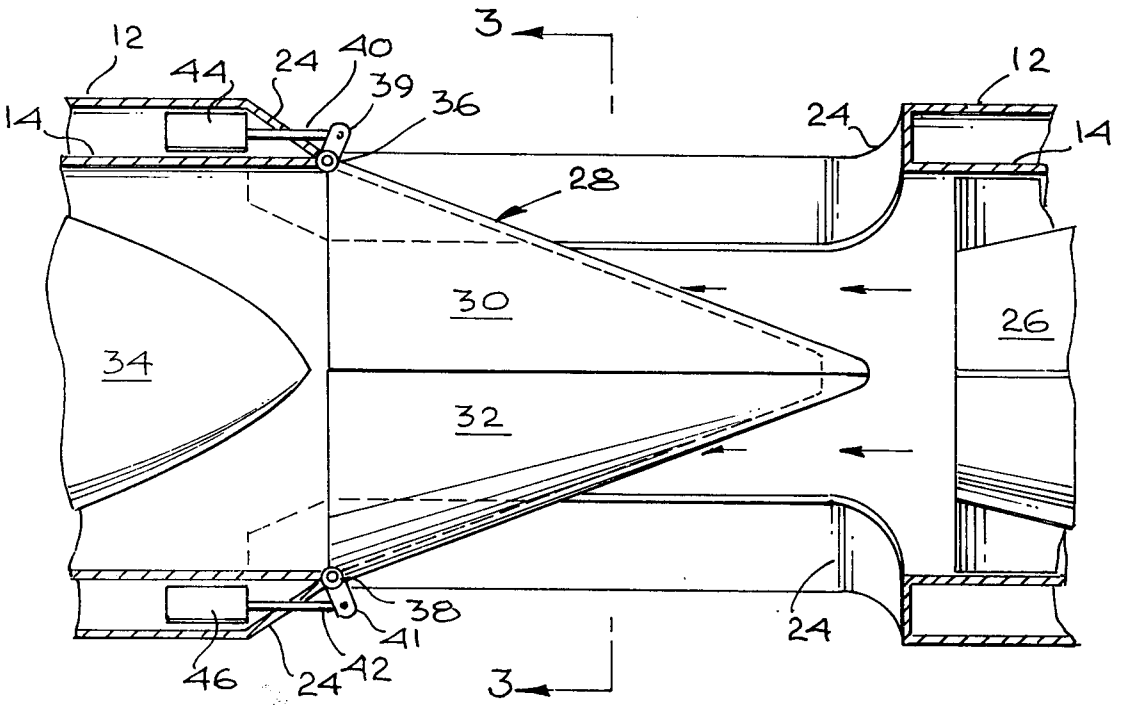
FIG. 2 is an axial section of the tube of FIG. 1 taken at the exhaust orifices showing the lever actuated conical deflector embodiment.

In FIG. 2, a portion of the tube at the exhaust orifices is shown in which outer shell 12 and inner shell 14 are supported and sealed together by crossmembers 24 at both of the orifices. Thus the orifices are defined by crossmembers 24, and no communication of exhaust gases between the outer and inner shells occurs. Exhaust gas from rocket 26 travels in the direction of the arrows in the figure, and impinges bifurcated conical deflector 28 on its upper half 30 and its lower half 32. Due to the angle of impingement of the exhaust gases, they tend to force deflector halves 30 and 32 together, and thus produce a seal between the halves which prevents exhaust gases from reaching rocket 34. Each half of conical deflector 28 also seals against a portion of crossmember 24 at its rearward end, and comes in contact with the surface of the inner rear shell section 14.

In addition, each half of deflector 28 is rotatably connected to crossmember 24 in the rearward section of the orifice. Upper and lower deflector halves 30 and 32 are hinged to the junction of crossmember 24 and inner tubular shell 14 in order to provide accurate positioning. Deflector hinges 36 and 38 are rotatably pinned in place, and connected to rods 40 and 42 through levers 39 and 41. The rods pass through crossmember 24 to actuators 44 and 46. Actuators 44 and 46 are positioned within the space between inner shell 14 and outer shell 12 of the launch tube, and may be hydraulically, pneumatically or spring-biased to the position shown so that deflector halves 30 and 32 are normally in the closed position. In the alternative, actuators 44 and 46 may be servo units which are normally positioned as shown. When activated, however, they retract rods 40 and 42 and pivot deflector halves 30 and 32 about the deflector mounting pins, to remove the conical deflector halves from the center of the tube.

Figure 3:
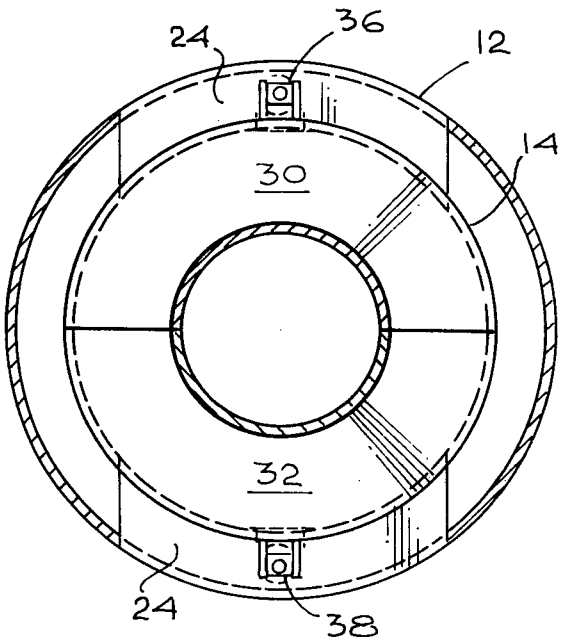
FIG. 3 is a section taken along line 3—3 of FIG. 2.

FIG. 3 depicts a preferred geometric arrangement of the components. For the sake of clairty the rockets have been omitted from this drawing. Also, the upper and lower halves of the exhaust gas deflector 30 and 32 are shown partially in section. They extend outward to the inner surface of inner launch tube 14, and are pinned thereto through deflector hinge members 36 and 38, respectively. Inner launch tube 14, outer launch tube 12 and crossmember 24 are shown in section and co-operate to form the exhaust gas orifices.

Figure 4:
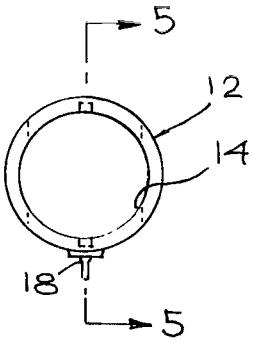
FIG. 4 is an end view of the tube without rockets and with the deflector open.

In FIG. 4, an end view of the launch tube without rockets is schematically shown. In this schematic view, outer launch tube 12 has launch tube positioning shoes 18 attached to it and surrounding inner launch tube shell 14.

Figure 5:
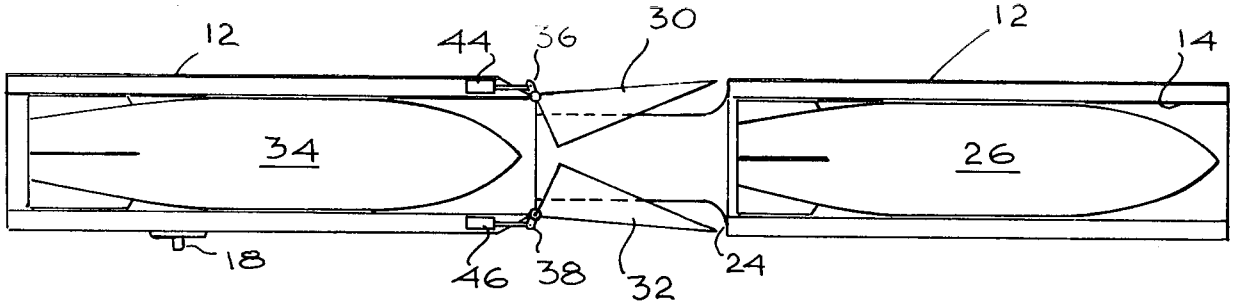
FIG. 5 is a sectional view taken along line 5—5 of FIG. 4.

In FIG. 5, a section taken along line 5—5 of FIG. 4 is shown with rockets in position. In this view, the preferred bifurcated conical deflector halves 30 and 32 are shown in the open position and do not block travel of, or in any way interfere with the motion of, aft rocket 34. The remaining structure is the same as that shown in FIG. 2.

Figure 6:
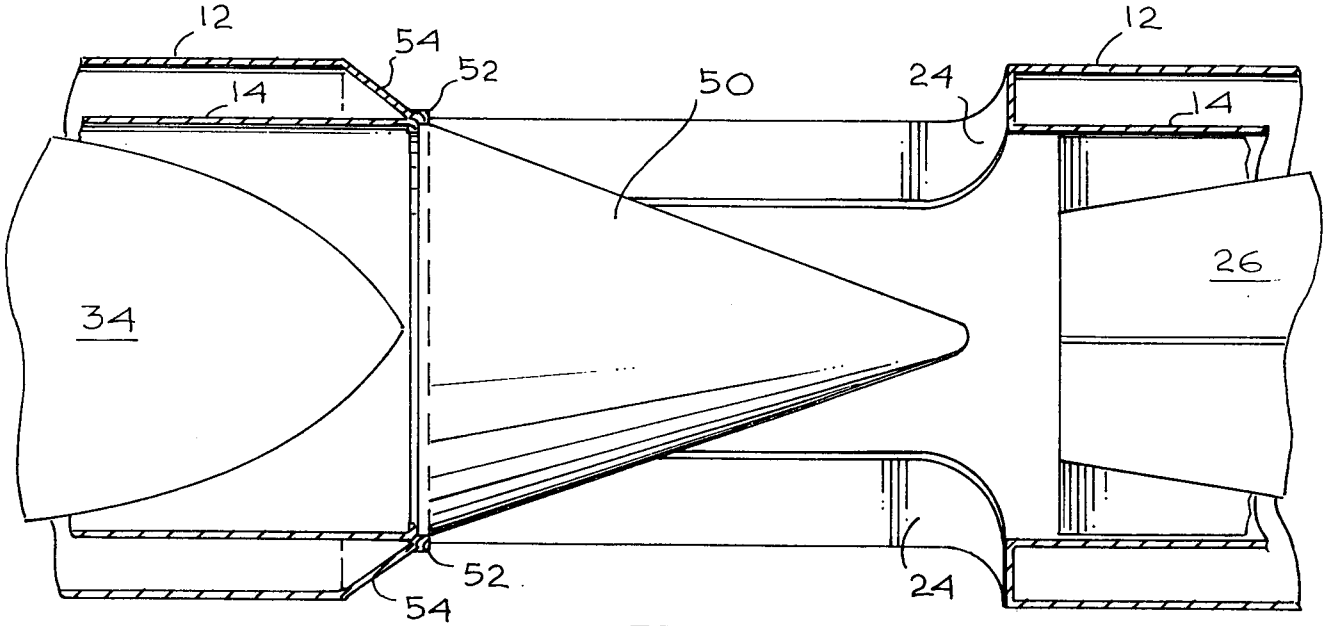
FIG. 6 is a detail of the solid deflector embodiment of the present invention.

In FIG. 6, an optional embodiment of the present invention, wherein the exhaust gas deflector 50 is not bifuracted, is depicted. In this figure, external launch tube 12, and internal launch tube shell 14 are interconnected at crossmember 24, as in the other figures. Also, forward rocket 26 is shown, as is rearward rocket 34. However, in this emboidment, conical exhaust gas deflector 50 is not made of two halves, but is provided with a cylindrical lip 52 which abuts the intersection of inner launch tube shell 14 and rear crossmember section 54. Conical exhaust deflector 50 is held in position by any convenient means, e.g. by clamps (not shown). The intersection between lip 52 and exhaust deflector 50 is, for instance, creased and breakable so that when rear rocket 34 is launched, after launch of rocket 26, rocket 34 travels forward, contacts exhaust gas deflector 50, disconnects it at the intersection between deflector 50 and lip 52 and pushes it forward and out of the forward section of the launcher.

In operation, both of the specific embodiments of the present invention operate in substantially the same manner. That is, in each case plural rockets are provided, the forward rocket is launched, and the conical exhaust gas defletor forces the exhaust gases out of the orifices provided in the launch tubes, with the forces applied to the whole of the unit being balanced. When a bifurcated conical unit is utilized, the exhaust gases tend to maintain the halves in a sealed relationship, and present the gases produced by launching of the first rocket from flowing into the section of the tube containing the second rocket. In various embodiments, the conical deflector is actuatable externally or by launching of the rearward rocket. In the alternative, a single deflector unit is used and it is pushed through the forward section of the launch tube by the rearward rocket during its launching.

Although there have been described above specific arrangements of a tandem rocket launcher, for particular use in the launching of shipboard and land based rockets, in accordance with the invention for the purpose of illustrating the manner in which the invention may be used to advantage, it will be appreciated that the invention is not limited thereto. For example, although the invention has been disclosed in the context of launch tubes utilized with rockets, the principles of the invention are equally applicable to surface-to-air missile launching units and the like. Accordingly, any and all modifications, variations, or equivalent arrangements which may occur to those skilled in the art should be considered to be within the scope of the invention as defined in the appended claims.

We claim:

1. In a tandem rocket launcher means for positioning plural axially aligned rockets having exhaust means interspersed along a tube for exhausting rocket gases from a first rocket before they impinge a second rocket behind the first, the improvement comprising:

a conical exhaust gas deflector adjacent the gas exhausting means effective to prevent launched rocket exhaust gas flow from said first rocket toward said second rocket by directing said gases out of said exhaust means interspersed along said tube, said gas deflector being bifurcated with each half rotatable toward the interspersed means about axes positioned external to the base of the conical deflector for symmetrically dispersing said exhaust gas flow, thereby providing for even back pressure on said first rocket.

2. The improvement of claim 1 wherein each half of the deflector is individually coupled to a lever and actuator for selectively rotating the section out of the path of the second rocket.

3. The improvement of claim 1 further including independent rotating means for each deflector half.

4. The apparatus of claim 3 wherein said tube comprises internal and external shells, said first and second rockets being mounted within said internal shell and wherein said independent means is located between said outer and inner shells.

* * * * *